United States Patent [19]

Hofmann

[11] 4,168,804

[45] Sep. 25, 1979

[54] FUEL INJECTION NOZZLE FOR INTERNAL COMBUSTION ENGINES

[75] Inventor: Karl Hofmann, Neckarrems, Fed. Rep. of Germany

[73] Assignee: Robert Bosch GmbH, Stuttgart, Fed. Rep. of Germany

[21] Appl. No.: 886,313

[22] Filed: Mar. 13, 1978

[30] Foreign Application Priority Data

Mar. 16, 1977 [DE] Fed. Rep. of Germany ..... 2711350

[51] Int. Cl.[2] ..... F02M 47/00

[52] U.S. Cl. ..... 239/533.11

[58] Field of Search ..... 239/533.3–533.12

[56] References Cited

U.S. PATENT DOCUMENTS 4,083,498 4/1978 Cavanagh et al. ..... 239/533.3

FOREIGN PATENT DOCUMENTS 2014215 10/1971 Fed. Rep. of Germany ..... 239/533.3

975205 10/1950 France ..... 239/533.5

*Primary Examiner*—Robert W. Saifer

*Attorney, Agent, or Firm*—Edwin E. Greigg

[57] ABSTRACT

The invention relates to fuel injection nozzles having a bored nozzle body terminating in a blind bore positioned in proximity to a plural series of fuel injection ports one series of which are in communication with a valve seat and arranged to be opened and closed by a slidable valve. The valve needle also includes an axial bore that provides for fuel pressure communication with the blind bore in the nozzle body.

6 Claims, 2 Drawing Figures

FUEL INJECTION NOZZLE FOR INTERNAL COMBUSTION ENGINES

BACKGROUND OF THE INVENTION

The invention relates to a fuel injection nozzle of the type for use in internal combustion engines provided with an axially movable valve needle, which is radially guided in a blind bore of a nozzle body and is loaded in the normal manner by a closing force. In nozzles of this type the frontal side opposite to the closing force together with a blind bore of the nozzle body defines a pressure chamber, which can be connected with a pressure line that serves to supply fuel to the nozzle. In these nozzles the pressure line extends through the nozzle body and opens into the blind bore and is correlated with the connecting channel. The connection between the pressure chamber and the pressure line is made by a connecting channel that begins in the outer surface of the guided section of the needle and runs through the valve needle. In this known fuel injection nozzle the valve needle is formed in several stages along the section that is guided in the nozzle body, and this has been found to involve difficulties with regard to the seal provided between the valve needle and the nozzle body. While it is relatively simple to match a bore and an element disposed therein that seals as tightly as possible, with multiple stage arrangements of bore and a valve needle it is practically impossible to maintain a desirable seal. While it is common in a simple assembly operation through a selection process to match somewhat larger elements to correspondingly larger bores during machining, this is not possible to be conducted in a satisfactory manner with multiple stage valve needles and nozzle bores. A further disadvantage of these known fuel injection nozzles is that pressurized fuel can flow between the valve needle and the nozzle body to the injection openings, which has the result of substantially decreasing the quality of the exhaust gas.

OBJECT AND SUMMARY OF THE INVENTION

The invention relates to a fuel injection nozzle in which the valve needle is formed as a shaft and controls fuel injection openings as a slide valve. The pressure chamber is arranged in a blind bore of the nozzle body and is defined by the frontal side of the valve needle and the bore. The fuel supply to the pressure chamber takes place through a connecting channel arranged in the valve needle, the beginning of which connecting channel communicates with the end of the fuel pressure line. An annular groove, which is relieved of pressure, is provided as a pressure block between the pressure chamber and the beginning of the connecting channel on the outer surface of the valve needle.

The fuel injection nozzle according to the invention has the advantage of providing a relatively simple machining operation which produces a valve needle that somewhat resembles a roller that has a V-shaped kerf, with which a high level of sealing is attained in the guided sections between the valve needle and the nozzle body, and that in addition any leakage is avoided by a pressure block.

Another advantage of the present invention is that the nozzle body is provided with an interiorly disposed conical valve seat adjacent to the blind bore and that the valve needle includes a cone-shaped zone for operation with said valve seat.

Still another advantage of this invention is that at least one injection opening extends from the valve seat through the nozzle body to the exterior thereof.

The invention will be better understood as well as further objects and advantages thereof become more apparent from the ensuing detailed description of a preferred embodiment taken in conjunction with the drawing.

DESCRIPTION OF THE PREFERRED EMBODIMENT

Figure 1:
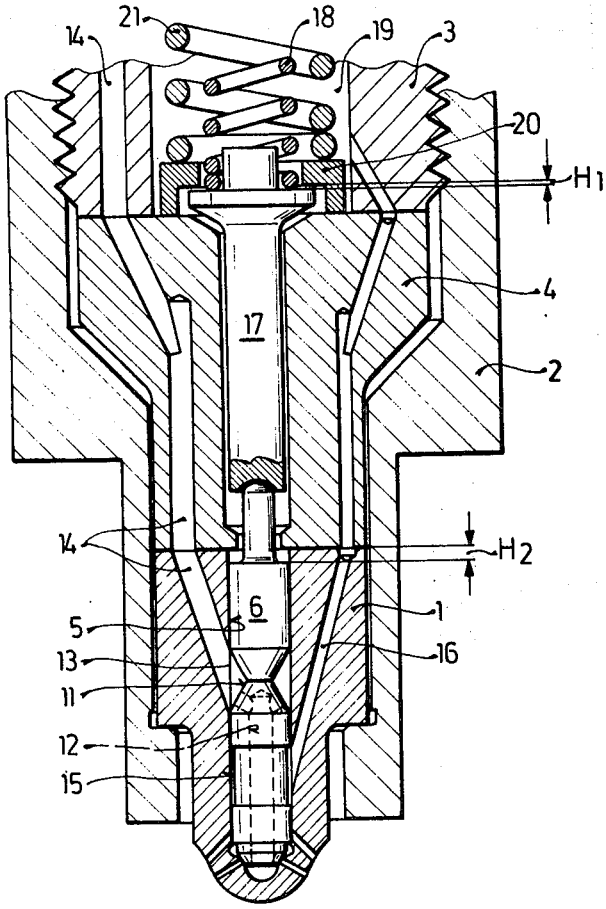
FIG. 1 is a fragmentary sectional view through the lower portion of a fuel injection nozzle.

Turning now to the drawing, the lower portion of a fuel injection nozzle in partial longitudinal section according to the present invention is shown in FIG. 1. A nozzle body 1 is held against an only partially shown nozzle holder 3 by a cap nut 2. An intermediate plate 4 is arranged between the nozzle body 1 and the nozzle holder 3. A valve needle 6 is arranged in a blind bore 5 of the nozzle body 1 so as to be radially sealed and axially movable. The valve needle 6 which includes a sealing cone 7 is arranged to rest on a valve seat 8 and defines with its lower frontal side 9 a blind bore 10 disposed in the nozzle body 1 and thus serves as a pressure chamber.

The valve needle 6 is formed as a slide valve and is guided over most of its entire length in the blind bore 5 of the nozzle body 1. In its exterior surface is arranged an annular groove 11 which is connected with the pressure chamber 10 by means of an axially arranged channel 12, which runs through the valve needle 6. The annular groove 11, on the other hand, is in continuous communication with an opening 13 of a pressure line 14, which extends through the nozzle holder 3, the intermediate plate 4 and the nozzle body 5. In addition, a second annular groove 15 is arranged in the outer surface of the valve needle 6, namely between the sealing cone 7 and the annular groove 11. This second annular groove 15, which serves as a pressure block, is relieved of pressure by a relief channel 16.

The valve needle 6 is loaded by means of a spring 18 which is supported on an annular shoulder provided on plate 17, said spring 18 being arranged in a spring chamber 19 of the needle holder 3. The discharge channel 16 opens into spring chamber 19, which is accordingly fully relieved of pressure. After completion of the first stroke $H_1$ the support plate 17 for spring 18 strikes a stop ring 20, which in turn supports a second closing spring 21.

Figure 2:
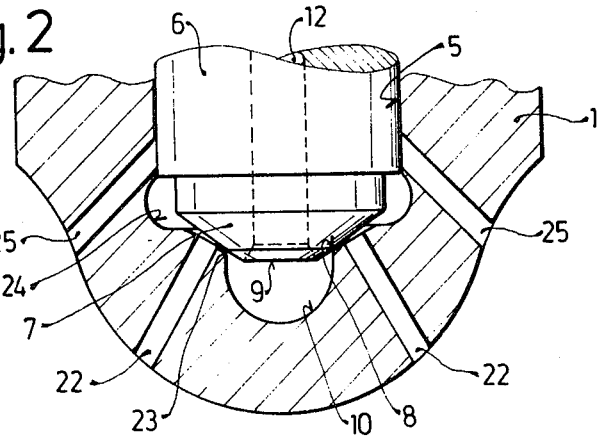
FIG. 2 is a magnified sectional view of the nozzle in the area of the valve seat.

Referring at this time to FIG. 2, it will be seen that injection openings 22, which are arranged in the nozzle body 1, are arranged in the valve seat 8, with these injection openings 22 adapted to be controlled by the sealing cone 7 of the valve needle 6. Because it is very difficult to maintain a precise covering of the injection openings 22 by the sealing cone 7, as shown in FIG. 2, the slope of the valve cone 7 is greater than that of the valve seat 8. In this manner there results a linear seat 23, which separates the pressure chamber 10 from the injection openings 22. For manufacturing convenience, there is an annular chamber 24 of a somewhat larger diameter disposed between the cylindrical bore section of the blind bore 5 and its end, so that after the valve needle 6 lifts away from the seat 8 an additional pressure stage is effective.

OPERATION

The fuel injection nozzle according to this invention operates in the following manner: As soon as the fuel from the fuel injection pump (not shown) travels through the pressure line 14 and the connecting channel 12 and arrives in the pressure chamber 10, the valve needle 6 is pushed upwardly against the force of the spring 18 until it reaches the stop ring 20. In so doing, the sealing cone 7 lifts away from the valve seat 8 and thereby opens the injection openings 22. At this time fuel also flows into the annular chamber 24. Not until there is a further increase of the fuel pressure is the valve needle 6 then pushed against the spring 18 and the spring 21, until the valve needle strikes the intermediate plate 4 after completion of the entire stroke $H_2$ by the valve needle. During this strike the injection openings 25, which begin in the inner surface of the bore 5 and lead to the combustion chamber, are opened. In contrast to the injection openings 22, these injection openings 25 are opened by reason of the valve needle 6 sliding upwardly in the nozzle body 1.

In order to prevent pressurized fuel other than that from the pressure chamber 10 from passing from the annular groove 11 to the injection openings 25, the annular groove 15 serves as a pressure relieving channel.

The foregoing relates to preferred exemplary embodiments of the invention, it being understood that other embodiments and variants thereof are possible within the spirit and scope of the invention, the latter being defined by the appended claims.

What is claimed and desired to be secured by letters patent of the United States is:

1. A fuel injection nozzle for internal combustion engines comprising, in combination, a nozzle body having a blind bore, an axially displaceable, shaft-like valve needle radially guided in said nozzle body blind bore, means disposed adjacent the upper end of said valve needle for yieldingly urging said valve needle in a closing direction, the front face of said needle remote from said urging means together with the blind end of said nozzle body blind bore defining a pressure chamber, a pressure line extending within said nozzle body for supplying fuel to the nozzle, a connecting channel extending within the outer surface of said needle for connecting said pressure chamber with said pressure line, said connecting channel beginning in the portion of said needle guided within said blind bore, said pressure line being arranged to discharge fuel into said blind bore opposite the beginning of said connecting channel, said valve needle having the same diameter, representing the largest diameter, at least in the section located between said beginning of said connecting channel and said pressure chamber and a pressure-relieved annular chamber serving as a pressure barrier disposed within said valve needle section.

2. A fuel injection nozzle in accordance with claim 1, including a conical valve seat disposed in said nozzle body between said blind bore and said blind end of said blind bore, said valve needle having a sealing cone which cooperates with said valve seat.

3. A fuel injection nozzle in accordance with claim 2, including at least one injection port disposed within said nozzle body, said at least one injection port having one end opening into said valve seat.

4. A fuel injection nozzle in accordance with claim 3, wherein said valve seat and said sealing cone have a slightly different slope, said valve seat and said sealing cone defining a linear seat extending between said blind end of said blind bore and said at least one injection port.

5. A fuel injection nozzle in accordance with claim 3, including at least one injection port having one opening in the wall of said blind bore, and wherein said valve needle controls with its shaft said at least one injection port in accordance with the stroke of said valve needle.

6. A fuel injection nozzle in accordance with claim 1, wherein said urging means includes a plurality of springs, said plurality of springs being arranged to urge said valve needle in a closing direction in series.

* * * * *